United States Patent [19]

Mercurio

[11] Patent Number: 4,721,243

[45] Date of Patent: Jan. 26, 1988

[54] LIQUID CARRYING CONTAINER AND BLANK

[75] Inventor: Franco, Mercurio, Milan, Italy

[73] Assignee: Elopak A/S, Lier, Norway

[21] Appl. No.: 910,807

[22] Filed: Sep. 22, 1986

Related U.S. Application Data

[63] Continuation of Ser. No. 652,458, Sep. 19, 1984, abandoned.

[30] Foreign Application Priority Data

Sep. 20, 1983 [IT] Italy ..... 22929 A/83

[51] Int. Cl.[4] ..... B65D 5/06

[52] U.S. Cl. ..... 229/137; 229/138; 229/140

[58] Field of Search ..... 229/17 R, 17 G, DIG. 9, 229/137, 138

[56] References Cited

U.S. PATENT DOCUMENTS

| | | | |
|---|---|---|---|
| 1,915,026 | 6/1933 | Meyer-Jagenberg | 229/37 R |
| 2,395,663 | 2/1946 | Howard | 229/37 R |
| 2,682,208 | 6/1954 | Monroe et al. | 93/36 |
| 3,275,214 | 9/1966 | Carangelo | 229/17 R |
| 3,389,849 | 6/1968 | Egleston | 229/17 G |
| 3,490,678 | 1/1970 | James et al. | 229/17 G |
| 3,604,613 | 9/1971 | Haas | 229/17 G |
| 3,797,726 | 3/1974 | Reil | 229/17 R |
| 3,918,236 | 11/1975 | Allen | 53/29 |
| 4,126,263 | 11/1978 | Martensson | 229/17 R |
| 4,190,190 | 2/1980 | Halonen | 229/17 R |
| 4,313,553 | 2/1982 | Lisiecki | 229/17 G |
| 4,526,314 | 7/1985 | Reil | 229/17 R |

FOREIGN PATENT DOCUMENTS

| | | | |
|---|---|---|---|
| 0074340 | 3/1983 | European Pat. Off. . | |
| 1247747 | 10/1960 | France | 229/17 R |
| 583500 | 10/1958 | Italy | 229/17 G |
| 1067602 | 5/1967 | United Kingdom | 229/17 G |

*Primary Examiner*—Stephen Marcus
*Assistant Examiner*—Gary E. Elkins
*Attorney, Agent, or Firm*—Dann, Dorfman, Herrell and Skillman

[57] ABSTRACT

A container blank particularly suitable for carrying liquids formed from a paperboard web fed in from a roll, the upper and lower edges of which are provided with short cut lines along the score lines forming the side panels. The method for obtaining such as blank consists of a set of rectilinear cut lines spaced apart from each other in correspondence of said upper and lower edges executed at the same time as said short cut lines or during a following stage, the lips defined by short cut lines and by score lines parallel to the edges being folded over and brought into contact with the corresponding panels simultaneously with the carrying out of short cut lines or later after the side seaming of the blank; in this way the container can selectively exhibit different types of top and bottom end closures.

1 Claim, 11 Drawing Figures

LIQUID CARRYING CONTAINER AND BLANK

This application is a continuation of application Ser. No. 06/652,458, filed Sept. 19, 1984, now abandoned.

The present invention relates to a suitably processed paperboard container particularly adapted for liquids, to the container blank defined by score lines on a paperboard web fed in from a roll and to a method for obtaining said blank.

According to the known art and as desclosed in the U.S. Pat. No. 2,682,208, in order to obtain containers of the gable-top type the paperboard web supplied from a roll is cut-out by adopting a method according to which portions are cut-out of the side edges of the web in order to form the patterns of the upper and lower container closure members. So the various adjacent blanks defined by said closure patterns and side panels with their corresponding score lines at right angles to the web feeding direction are obtained by cutting the web at successive intervals, making rectilinear cuts at right angles to the feeding direction of the same web.

This procedure for manufacturing blanks has however a drawback in that a lot of wastage is produced consisting of the paperboard portions cut out of the web edges in the form of offcuts.

Furthermore, the above mentioned offcuts, besides representing a wastage of material, create some difficulties when said offcuts have to be evacuated and, as a result, give rise to unsatisfactory working times.

A further method is described in the EU Patent Application No. 0074340 in which it is possible to obviate some drawbacks, such as for example the presence of waste paperboard. In fact, this can be obtained according to an embodiment described in the above patent application in which the profiled cut of the blanks takes place at right angles to the feeding in of the web and to the side panels of the same blank. However this method is not flexible enough, as a single kind of blank can be accomplished having upper and lower closure members provided with particular characteristics.

According to a further embodiment of the same patent application it is possible to obtain a different arrangement of the upper and lower closure members but in this case there is an appreciable waste of paperboard and the cutting procedure is more complicated and therefore requires a longer working time.

An object and a technical problem of the present invention is to obviate the drawbacks of the known art attaining, as a result, a simplified cutting procedure for the blanks and therefore an increased production of the same, being also possible to obtain liquid-carrying containers provided with any kind of upper or lower closure, accomplished by means of simple folding or cutting operations.

The solution to this technical problem is particularly attained by means of a continuous paperboard web supplied from a roll and formed of a set of adjacent equal blanks defined by score lines, each blank being provided with parallel score lines essentially forming four side panels and a narrower fifth panel or closure panel parallel to each other and defined by rectilinear side edges, an upper edge and a lower edge at right angles to the side edges and score lines comprising upper and lower closure triangles cooperating to the forming of the upper and lower closure members, characterized in that in correspondence of each upper closure triangle there is a score line of the same width as the upper triangle side, at right angles to said side edges and disposed between the upper edge of each blank and the line parallel to the edge joining the vertices of said upper closure triangles turned towards said upper edge.

Advantageoulsy each blank thus obtained is characterized in that its upper edge is provided with upper short cut lines at right angles to said edge along the lines forming the side panels and terminating in the points in which the last mentioned lines intersect the ends of the above mentioned score lines having substantially the same width as the upper triangle side and in that the two upper lips defined by the two pairs of upper short cut lines extending as far as the ends of the score lines having the same width as the upper triangle side are folded-over about said lines and contact their corresponding panels.

Thus the method to form the above mentioned blanks is characterized in that it comprises a set of rectilinear cut lines spaced apart from each other executed at the same time that the upper and/or lower short cut lines are, the latter being also susceptible of being carried out in a following time after the blank side seaming, so that each rectilinear cut line gives rise to the formation of the upper edge of the first blank or blanks disposed side by side and at the same time to the formation of the closure edge of the second blank or blanks disposed side by side.

Lastly, the container thus obtained is characterized in that the arrangement and/or length and/or number of the upper and lower short cut lines and of their corresponding lips are such that they can give rise to any type of upper and lower closure.

As above explained, the present invention allows to obtain any possible blank, particularly also the type disclosed in the U.S. Pat. No. 4,313,553, which is a further improvement with respect to the known methods for opening the upper closure and pouring the liquid.

By adopting the simple cut procedure being part of the present invention either the web fed in from the roll can be cut into its individual blanks at the factory, in order to supply a filling machine of the type described in the U.S. Pat. No. 3,918,236 or the roll can be directly mounted on the filling machine so that the blanks are cut thereon and then formed, filled and sealed.

Using a single blank it is possible to obtain any kind of container so that the filling machines utilized can have many parts in common, being only different in those parts that concern the particular closure characteristics which differentiate them from each other.

The individual blanks can be provided at the same time both with rectilinear and short cut lines directly at the factory or the short cut lines can be made later on during the production process when the blanks are already side seamed on the filling machine.

So the folding of the lips can be performed at the factory during the cutting process or on the filling machine. These advantages are very important above all for the construction of liquid-carrying containers such as milk, juice, etc. as, owing to their large production, a saving of time and material for each container positively influences the whole production.

The following description is given hereinafter by way of example only and for purposes of illustration but not of limitation, reference being made to the accompanying drawings, in which:

FIG. 1 shows the web supplied from a roll provided with the score lines of the different blanks with a transverse perpendicular cut line;

FIGS. 2*a*, 2*b*, 3*a*, and 3*b* are further examples of the web cut lines;

Figure 1:
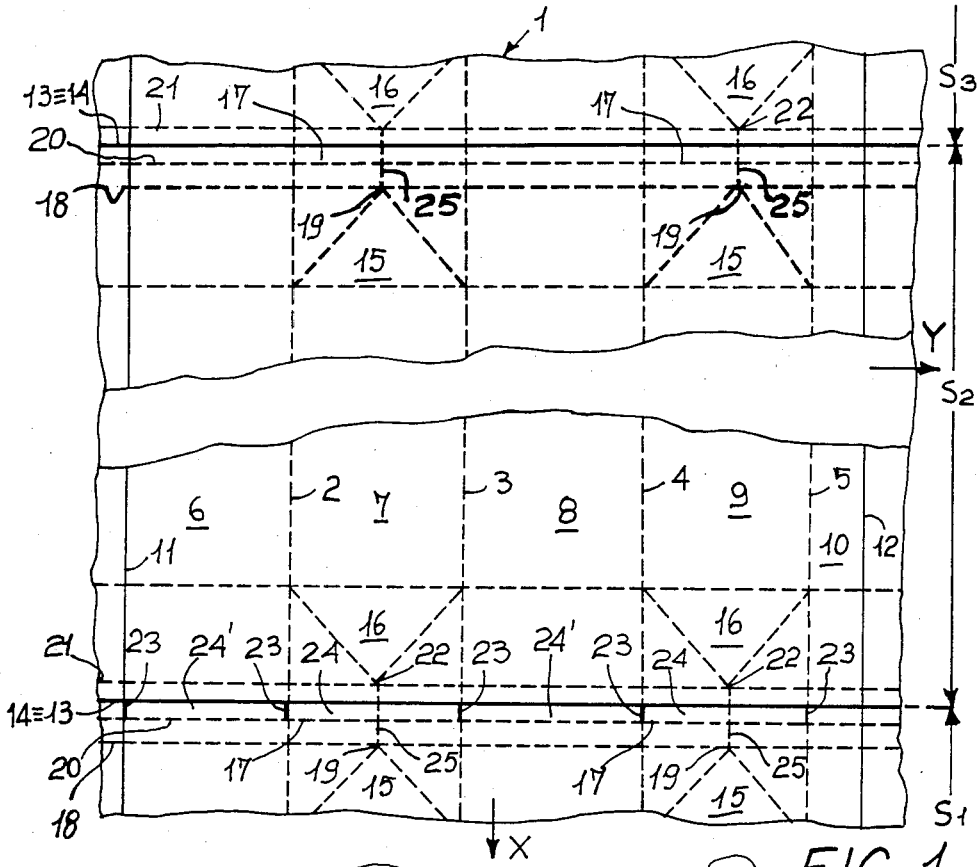
Figure 2A:
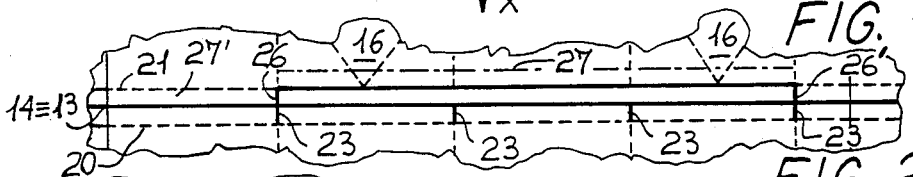
Figure 2B:
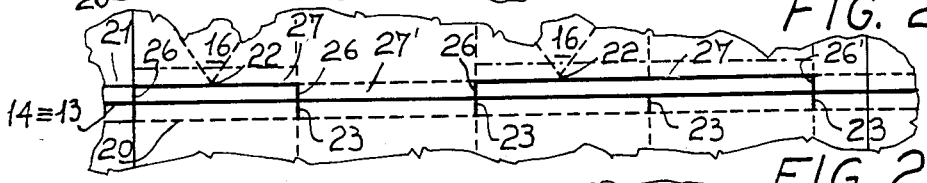
Figure 3A:
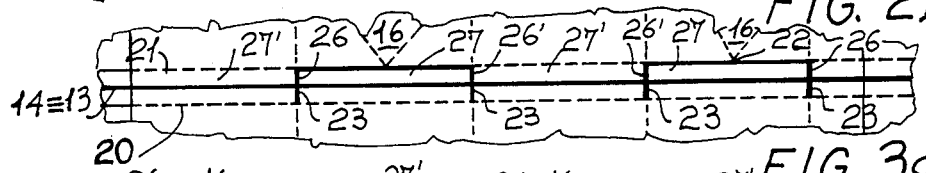
Figure 3B:
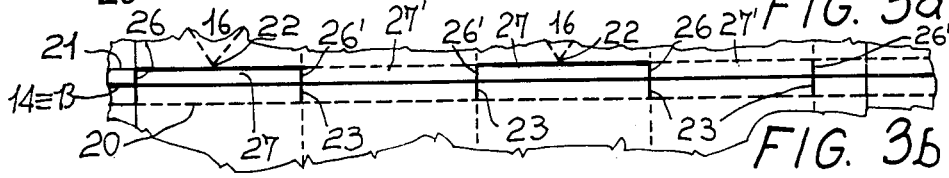

Referring to FIG. 1, a continuous paperboard web 1 is supplied from a roll not shown in the drawings.

This web suitable for the formation of containers, particularly liquid-carrying containers, consists of a set of adjacent blanks S1, S2, S3 equal to each other and provided with score lines. Each blank is provided with parallel score lines 2, 3, 4, 5 forming four side panels 6, 7, 8, 9 and a narrower fifth panel 10 or side closure panel and is defined by rectilinear side edges 11 and 12, an upper edge 13 and a lower edge 14, both rectilinear.

In addition, each blank is provided with the well-known top 15 and bottom 16 closure triangles consisting of score lines cooperating to the upper and lower closure of the containers formed from said blanks.

Next to each top triangle 15 there is a score line 17 that has substantially the same width as the side of the top triangles 15, at right angles to the side panels 6, 7, 8, 9 and disposed between the blank upper edge 13 and the line 18 parallel to the edge 13 and joining the vertices 19 of the top closure triangles 15.

Particularly, lines 17 can be joined by a score line 20 extending as far as the side edges 11 and 12 of the different adjacent blanks.

Furthermore, a score line 21 is disposed parallel to the lower edge 14 of each blank, joining the vertices 22 of the bottom closure triangles 16 of each blank.

As shown in FIG. 1, the upper edge 13 of a set of first adjacent blanks S1 coincides with the lower edge 14 of a set of second adjacent blanks S2, so the upper edge 13 of the blank set S2 coincides with the lower edge 14 of the blank set S3, and so forth.

Particularly, the score lines 17 represent a novelty introduced by the present invention as they are combined with the upper short cut lines 23 at right angles to the upper edge 13 along lines 2, 3, 4, 5 and terminating in the points of intersection between the last mentioned lines and the ends of the score lines 17, thus forming the upper lips 24 that, as will be explained below, constitute the membrane cooperating with the top end closure of some kinds of containers. The short cut lines 23 have been shown with reference to the blank set S1.

The four panels 6, 7, 8, 9 can either be all substantially the same width or equal by opposite pairs.

For the sake of completeness, it should be noted that score lines 25 are provided at right angles to the upper edge 13 and joining the vertices 19 of the top triangles 15 forming one set of adjacent blanks to the vertices 19' of the bottom triangles 16 forming a second set of adjacent blanks.

The web between the lower edge 14 of each blank and the score line 21 can either be continuous as seen in FIG. 1, being adapted, in a simple manner, to forming a bottom closure in combination with the corresponding bottom triangles 16 or be provided with one or more lower short cut lines 26, 26' at right angles to edge 14 along one or more of the parallel lines 2, 3, 4 and 5 and extending as far as the score line 21 that connects the vertices 22 of the bottom closure triangles 16, as shown in the examples of FIGS. 2*a*, 2*b*, 3*a* and 3*b*.

Cut lines 26, 26' are selected, as will be explained below, so that their number and arrangement could be adapted for the type of bottom end closure that it is desired to adopt and also depending upon the arrangement of the bottom triangles 16.

The upper lips 24 defined by two adjacent upper short cut lines 23 and extending as far as the ends of the score lines 17, are folded over about the last mentioned score lines and brought into contact with the corresponding panels, in order to obtain an upper profiled pattern, adapted, as will be explained later, to accomplishing containers provided with an upper gable-top closure. If a differently arranged top end closure is desired, the above mentioned lips 24 can be left in the same plane as their corresponding panels, that is unfolded, thus obtaining an upper flat top closure, as will be explained below. The four upper lips 24 and 24' defined by the upper short cut lines 23 and by the score line 20 can also be folded over about said line 20 and brought into contact with the corresponding panels.

The lower lips 27, of different length, as seen in FIGS. 2, 2 bis, 3, 3 bis, defined by the lower short cut lines 26 and 26' and extending as far as the score line 21 that connects the vertices 22 of the bottom closure triangles 16, are cut out or folded over about said line 21 and brought into contact with the corresponding panels, the selected arrangement thereof depending upon the desired type of bottom end closure, while lips 27' defined by the cut lines 26—26 and 26'—26' are maintained in position.

Figure 4:
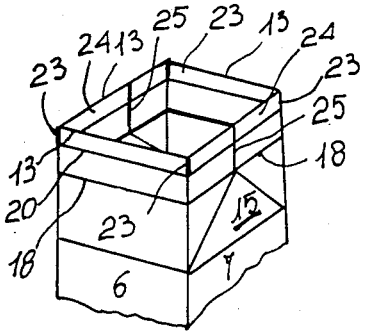
FIG. 4 shows a side seamed blank before the foldings.

It should be pointed out that the upper and lower short cut lines as well as the folding of said lips against the corresponding panels can be carried out on the open blank or later on the seamed blank, shaped as seen in FIG. 4.

From what above it can readily be understood that by means of one web 1 and of the blanks obtained therefrom it is possible to have different types of containers having different top and bottom end closures, as will be described below.

Figure 5:
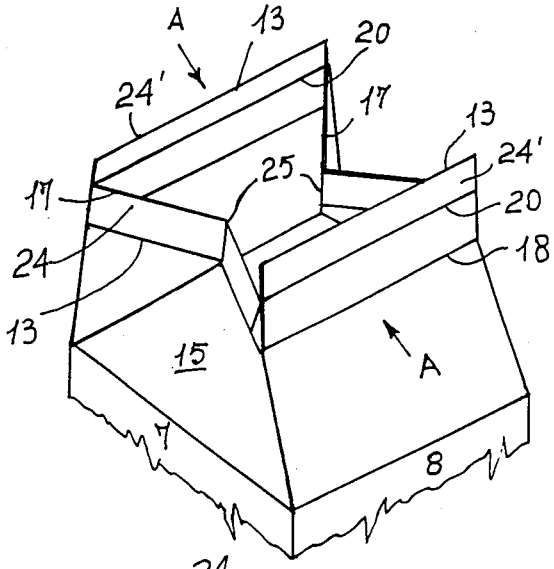
FIGS. 5 to 9 are different types of top end and bottom end closures for the containers obtained from the blanks of the invention.

FIG. 5 shows an upper gable-top closure, lips 24 being folded about lines 17. This closure takes place in a known manner, causing the opposite lips 24' to come into contact with each other according to arrows A—A until said lips 24' are disposed at right angles and thus sealed together.

Figure 6:
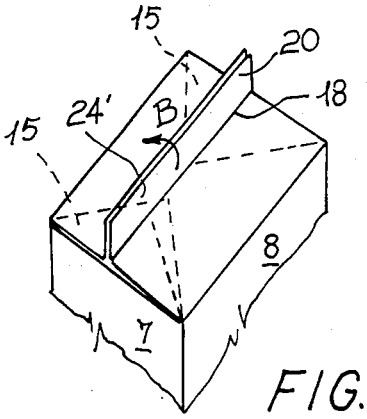

From said gable-top closure it is possible to obtain, in a known manner, a flat-top closure causing the lips 24' in contact with each other to rotate according to arrow B in FIG. 6, so that the same can be brought to a horizontal position above the flat-top.

Figure 7:
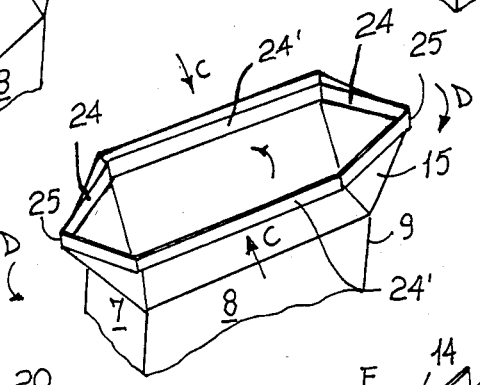

Maintaining the upper lips 24 and 24' in the same plane as the corresponding panels or all of them folded about line 20, it is possible to obtain a top end closure as seen in FIG. 7 causing the lips 24 and 24' to contact each other according to arrows C—C about the vertical score lines 25. Then the projecting flaps formed from the upper triangles 15 are folded down according to arrows D—D and caused to come into contact with the opposite side panels 7 and 9.

Figure 8:
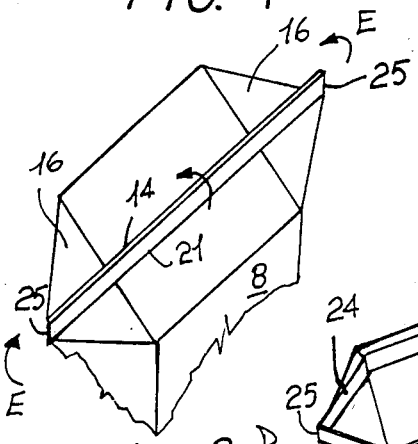

Being the bottom end closure members arranged as shown in FIG. 1, it is possible to obtain, in a known manner, a closure as seen in FIG. 8 in which lips defined by the lower edge 14 and by the score lines 21 about the vertical score lines 25 are brought into contact with each other and sealed together; then the projecting flaps formed from the lower triangles 16 are folded up according to arrows E—E and caused to come into contact with the lower flat surface.

A further bottom closure structure can be similar to the top closure shown in FIG. 6 where the bottom triangles 16 are folded in at the inside of the container.

The different hereinbefore described types of top and bottom closures according to the arrangement of FIG. 1, that represent a large variety thereof fulfilling the different requirements as to the container construction and the pouring of liquid therefrom, are carried out by means of simple fold and cut operations without wastage of paperboard in the form of offcuts.

Figure 9:
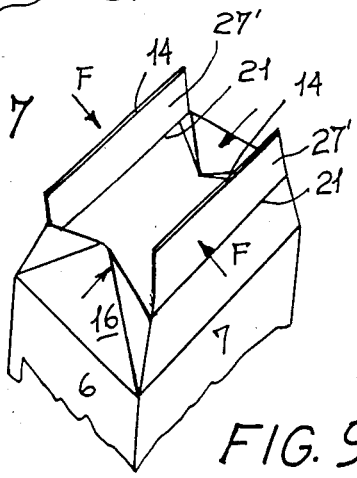

If other types of known bottom end closures are desired, it is necessary to have to resort to the examples illustrated in FIGS. 2, 2 bis, 3 and 3 bis in which lips 27' are maintained in position while lips 27 are either cut out or folded in about line 21. In this case a closure of the type seen in FIG. 9 is for example obtained corresponding to the arrangement of FIG. 3 bis in which the facing lips 27 are rotated and brought into contact with each other till they appear overlapped on the lower flat surface.

Further bottom closures corresponding to the arrangements of FIGS. 2, 2 bis and 3 can be obtained.

Turning now to the method for forming the blanks described above, it comprises a set of rectilinear spaced cut lines in correspondence of the edge 13≡14 executed simultaneously with the upper 23 and lower 26 and 26' short cut lines, these short cut lines being also susceptible of being carried out later after the blank side seaming; in this case the blank has the shape shown in FIG. 4 and its construction has reached a subsequent stage with respect to the cutting of the different individual blanks, the container being indifferently already filled or not yet. In this way each rectilinear cut line determines the formation of the upper edge 13 of the first blank or blanks disposed side by side S1 and at the same time the formation of the lower closure edge 14 of the second blank or blanks disposed side by side S2.

When the upper 23 and lower 26, 26' short cut lines are executed on web 1 at the same time with the rectilinear cut line 13≡14, the short cut lines project from both sides of said rectilinear cut line as shown in FIGS. *2a*, *2b*, *3a*, *3b*.

Said spaced rectilinear cut lines 13≡14 either with the upper and lower short cut lines or without them, can be executed transversely to the web 1, that is at right angles to arrow X, this being for example the feeding direction of the web, or longitudinally to the web itself and in this case the web would have a feeding direction according to arrow Y. In the latter case rectilinear cut lines next to the side edges 11 and 12 would also be necessary.

Obviously the choice between transverse and longitudinal cut lines will depend upon the width and length of the side panels of the different blanks, in order to obtain the best exploitation of the paperboard web, without wastage along the web side edges. It should be pointed out once again that the folding operations of the upper 24 and/or lower 27 lips or the cut out of the lower lips can be executed simultaneously with the short cut lines, that is during the spaced rectilinear cuttings of web 1 either at the factory or on the filling machine and also after the side seaming of the blank.

In the above description the foundamental principles of the present invention have been displayed and some embodiments given. However, it should be understood that modifications and variations may be made without departing from the spirit and scope of the invention itself.

I claim:

1. A rectangular container blank having two straight side edges and upper and lower edges comprising:

four side panels and a narrower fifth side closure panel defined by score lines parallel to each other and the side edges and score lines at an upper edge and at a lower edge of the panels at right angles to the parallel score lines, the fifth panel being seamable to another panel in forming a container:

upper and lower closure panels defined by extensions of the parallel score lines and further score lines outside of the side panels at right angles to the parallel score lines, alternate ones of which closure panels provide triangles defined by score lines exending from the respective upper and lower edges of the adjacent side panels to an apex at the further score line, one triangle on each closure panel having a base coincident, respectively, with the upper or lower edge of the adjacent side panels, the triangles permitting folding of the closure panels to form upper and lower closures of the container;

lip panels adjacent each closure panel defined by extensions of the parallel score lines to the upper and lower edges of the blank and a score line joining the apices of the upper and lower closure triangles and respectively the lower and upper edge of the blank, at least the lip panels at the top end of the blank having an intermediate score line parallel to and lying between the upper edge of the blank and the further score line separating the closure and lip panels; and short cut lines extending from the upper edge of the blank to the intermediate score line along said extensions of the parallel score lines forming the respective side panels.

* * * * *